US005187414A

United States Patent [19]

Fellows et al.

[11] Patent Number: 5,187,414

[45] Date of Patent: * Feb. 16, 1993

[54] FLUORESCENT LAMP CONTROLLERS

[75] Inventors: Mark W. Fellows; John M. Wong, both of Buffalo Grove, Ill.; Edmond Toy, Sunnyvale, Calif.; Robert A. Erhardt; James A. Thomsen, both of Chicago, Ill.

[73] Assignee: North American Philips Corporation, New York, N.Y.

[ * ] Notice: The portion of the term of this patent subsequent to Aug. 28, 2007 has been disclaimed.

[21] Appl. No.: 797,570

[22] Filed: Nov. 25, 1991

Related U.S. Application Data

[60] Division of Ser. No. 746,074, Aug. 12, 1991, which is a continuation of Ser. No. 516,003, Apr. 27, 1990, which is a division of Ser. No. 219,923, Jul. 15, 1988, Pat. No. 4,952,849.

[51] Int. Cl.[5] ..... H05B 41/36

[52] U.S. Cl. ..... 315/307; 315/DIG. 2

[58] Field of Search ..... 315/307, 308, 209 R, 315/224, DIG. 2, DIG. 5, DIG. 7, 291; 363/16; 307/157

[56] References Cited

U.S. PATENT DOCUMENTS

| | | | |
|---|---|---|---|
| 3,611,021 | 10/1991 | Wallace | 315/239 |
| 4,251,752 | 2/1981 | Stolz | 315/206 |
| 4,453,109 | 6/1984 | Stupp et al. | 315/219 |
| 4,498,031 | 2/1985 | Stupp et al. | 315/307 |
| 4,585,974 | 4/1986 | Stupp et al. | 315/307 |
| 4,698,554 | 10/1987 | Stupp et al. | 315/307 |
| 4,700,113 | 10/1987 | Stupp et al. | 315/227 |
| 4,717,863 | 1/1988 | Zeiler | 315/307 |
| 4,763,239 | 8/1988 | Ball | 315/244 |
| 4,914,356 | 4/1990 | Cockram | 315/307 |
| 4,924,149 | 5/1990 | Nishida | 315/307 |
| 4,952,849 | 8/1990 | Fellows | 315/307 |
| 4,992,702 | 2/1991 | Shimuzu | 315/307 |
| 5,048,033 | 9/1991 | Donahue | 315/307 |

FOREIGN PATENT DOCUMENTS 3233655 5/1983 Fed. Rep. of Germany .

*Primary Examiner*—Joseph A. Popek
*Assistant Examiner*—A. Zarabian
*Attorney, Agent, or Firm*—Edward Blocker

[57] ABSTRACT

An electronic controller for fluorescent lamps includes a DC to AC converter which supplies high frequency current to the lamps and a preconditioner stage which includes a switched mode power supply connected to accept line power and produce a DC input for the DC to AC converter. The switched mode power supply and the DC to AC converter are synchronized to operate in a fixed phase relationship and/or at the same frequency.

4 Claims, 6 Drawing Sheets

LOW HB VOLTAGE COMPARATOR
LAMP VOLTAGE COMPARATOR
START COMPARATOR
FREQ SWEEP
LAMP COR. ERROR AMP
ACTIVE RECT
PRIMARY CURRENT COMPARATOR
VLAMP OFF F/F
CLP F/F
VREG
DMAX
5/7 (VREG)
OV
V LAMP
START
3/14 (VREG)
4/7 (VREG)
FMIN
CRECT
LI1
LI2
IPRIM
-0.1V
2/7 (VREG)

FLUORESCENT LAMP CONTROLLERS

This is a division of application Ser. No. 07/746,074, filed Aug. 12, 1991 which is a continuation of application Ser. No. 07/516,003, filed Apr. 27, 1990 which is a division of application Ser. No. 07/219,923, filed Jul. 15, 1988 now U.S. Pat. No. 4,952,849.

BACKGROUND OF THE INVENTION

1. Field of the Invention

This invention relates to fluorescent lamp controllers and more particularly to controllers for operating fluorescent lamp or other loads at high efficiency while being very safe and highly reliable in operation and readily controllable and while achieving a long lamp life. The controllers of the invention are adaptable for use with different types and sizes of fluorescent lamps or with other loads and are readily and economically manufacturable.

2. Background of the Prior Art

It is well known that fluorescent lamps are more efficient when operated at higher frequencies. As a result of this fact and also as a result of continuing improvements in SMPS (Switch Mode Power Supply) circuits and components, there have been many proposals for using SMPS circuits operable at high frequencies for energizing and controlling fluorescent lamps. A relatively early disclosure is contained in the Wallace U.S. Pat. No. 3,611,021, issued Oct. 5, 1971. In the circuit as disclosed in the Wallace patent, a fluorescent lamp is connected in series with a capacitor to the secondary winding of a transformer which has a primary winding connected to a pair of switching transistors which alternately conduct to apply a square wave current to the oscillator the frequency of which is controlled in response to a current sense signal at the output. The secondary winding, the lamp and a capacitor are in series and form a tuned circuit which has a resonant frequency which is determined by the leakage inductance of the transformer and by the series capacitor. For starting, a second capacitor is connected in parallel with the secondary winding and the series combination of the first capacitor and the lamp, the second capacitor having a value such as to be resonant at a harmonic of the operating frequency.

The Stolz U.S. Pat. No. 4,251,752 discloses a circuit in which an inverter circuit having a constant frequency of operation is connected to a fluorescent lamp load and is supplied with a DC operating voltage developed across a capacitor by a variable duty cycle converter circuit which is connected to the output of a rectifier circuit. A loop amplifier circuit is shown having one input connected to a ramp circuit and a second input connected to the output of the rectifier circuit to be responsive to both rectifier current and voltage, the loop amplifier circuit being described as being operative to control the duty cycle of the converter circuit to maintain the input current to the rectifier in phase with the input voltage.

Additional disclosures relating to the use of SMPS circuits are contained in the Stupp et al. U.S. Pat. Nos. 4,453,109, 4,498,031, 4,585,974, 4,698,554 and 4,700,113. U.S. Pat. No. 4,453,109 discloses a high frequency oscillator-inverter with a novel leakage reactance transformer which provides not only the current limiting ballast function but also automatic control of heater power. U.S. Pat. No. 4,498,031 discloses a non-resonant coupling network which includes a reactive ballast impedance coupled between a lamp and the output of a trapezoidal waveform generator, with frequency being altered as a function of lamp current. U.S. Pat. No. 4,585,974 and U.S. Pat. No. 4,698,554 disclose driven inverters which are coupled to a lamp through non-resonant networks which include reactive ballast impedances, the frequency of the inverter as disclosed in each patent being controlled on a cycle-by-cycle basis as a function of the amplitude of lamp current. U.S. Pat. No. 4,700,113 discloses a circuit in which a high frequency inverter is coupled to a lamp through a reactive ballast impedance, the inverter being operated at a predetermined frequency until ignition occurs and its frequency being then automatically increased to a desired operating frequency.

The Zeiler U.S. Pat. No. 4,717,863 discloses a circuit which is similar to those of the Wallace and Stupp et al. patents in that frequency is controlled to control the output. Lamps are connected to the secondary winding of transformer and an inductor separate from the transformer is connected in series with a capacitor and a primary winding of the transformer to obtain an output which increases as the frequency is reduced, frequency being controlled by a photocell arrangement responsive to light output.

There are many other prior art disclosures of the use of SMPS circuits for energizing fluorescent lamp loads. Many of the prior art circuits and particularly those disclosed in the Stupp et al. patents have been very successful. However, for the most part, the SMPS circuits as proposed in the prior art have been such that they would be unduly expensive to manufacture and/or would have severe limitations with respect to performance and reliability and have not enjoyed substantial commercial success.

SUMMARY OF THE INVENTION

This invention was evolved with the general object of providing fluorescent lamp controllers which have a very high efficiency and which achieve a long lamp life while being extremely safe and reliable in operation and also being readily controllable. It is also an object of the invention to achieve such goals with controllers which are easily adaptable for use with different types and sizes of fluorescent lamps and which are readily and economically manufacturable.

Controllers constructed in accordance with the invention are similar to those disclosed in the aforementioned Stupp et al. patents in that a fluorescent lamp load is coupled to the output of a variable frequency DC-AC converter or inverter. A half-bridge circuit is used in an illustrated embodiment and it is supplied with a variable frequency gating signal which is controllable in response to lamp current to obtain a substantially constant lamp current.

Important features of the invention relate to the construction and mode of operation of an output circuit which couples the output of the variable frequency DC-AC converter circuit to the fluorescent lamp load. In the disclosed embodiment, an output circuit includes a resonant circuit and it is similar to that disclosed in the aforementioned Wallace patent in that it operates at a frequency above resonance and also in that it includes a resonant capacitor which is connected in circuit with the secondary winding of a transformer and the load, the resonant frequency being determined by the values of the leakage inductance of the transformer and the value of the capacitor. However, the construction of the output circuit and the control of its operation, through control of the variable frequency DC-AC converter, are quite different from those disclosed by the Wallace patent, particularly with respect to connections and characteristics of circuit components and control of starting operations and operations after starting, providing a number of important advantages.

In a controller of the invention, the output circuit operates as a tuned circuit having characteristics such that a voltage is produced which is sufficient for ignition at a frequency which is offset in one direction from a resonant frequency. The tuned circuit has characteristics such that the frequency may then be controlled after ignition in a range offset in the same direction from a resonant frequency to control lamp output. A control circuit is provided for automatically operating upon energization of the controller for operating the DC-AC converter at a certain high frequency, above that at which ignition would normally occur, and then gradually reducing the frequency until ignition occurs, the control circuit being then operative to control the lamp current through control of the frequency of operation of the DC-AC converter.

Preferably, the resonant frequency is below the ignition and operating frequencies and a specific feature relates to the provision of an arrangement such that the resonant frequency is reduced in response to the increased load which occurs upon lamp ignition, operative in a manner such as to insure operation at a frequency above resonance and to obtain a high degree of reliability. Preferably a transformer is used of a type similar to that disclosed in the aforementioned Stupp et al. U.S. Pat. No. 4,453,109. It is found that the use of such a transformer facilitates the automatic reduction in the resonant frequency as a function of load.

The use of the arrangement including such a transformer has an additional important advantage in that such a transformer is operable to automatically control magnetic coupling between a primary winding and filament windings. A tighter magnetic coupling to the filament windings is obtained during a pre-heat phase of operation in which the load is very light and the ignition phase is then initiated. Upon ignition to enter an operating phase, the transformer is such as to respond to the increased load and automatically reduce the magnetic coupling to the filament windings and lower the filament voltage. The arrangement thus operates to prevent damage to and to extend the life of the filaments.

Another specific feature of the output circuit relates to the connection of the resonant capacitor in parallel relation to the fluorescent lamp load and the transformer winding so as to limit the voltage across the winding in accordance with lamp voltage. The parallel arrangement also facilitates the use of a single resonant capacitor for both the ignition and operating phases.

With the aforementioned features, stable operation in a range well above the resonant frequency is facilitated, which has a very important advantage in insuring that transistors of the DC-AC converter are protected against a capacitive load condition, i.e., one in which the current leads the voltage and in which destruction of the transistors might result. A further feature relates to the provision of additional protection through the use of circuitry which automatically switch to a safe condition when the phase of current relative to voltage is less than a certain safe value, preferably by sweeping the DC-AC converter to a high frequency.

Additional features of the invention relate to the provision of a pre-conditioner circuit which is supplied with a full-wave rectified 50 or 60 Hz voltage and which includes SMPS circuitry operating as an up-converter to supply a DC voltage to the DC-AC converter which is automatically maintained at a relatively high level for stable efficient operation. The automatic level control is obtained by controlling the width of gating pulses applied to the circuit in response to a signal which is proportional to the average value of the output voltage of the pre-conditioner circuit.

A specific feature is that the pulse width is also controlled in response to a second signal which is proportional to the instantaneous input signal to the pre-conditioner circuit, in a manner such as to obtain power factor control while also obtaining the aforementioned automatic level control. Preferably, the sum of an inversion of the second signal and a constant are multiplied by the first signal which is proportional to the average output voltage, to obtain a signal for control of pulse width. It is also preferable that the circuit be operated in a discontinuous mode. It is found that excellent results are obtained, both with respect to obtaining the desired current waveform and with respect to obtaining a substantially constant output level, by combining only the two signals in this manner. The invention avoids instability problems from a feedback loop which results when a signal corresponding to input current is used in controlling pulse width.

A number of very important additional features of the invention relate to the construction and operation of a control circuit which controls both the DC-AC converter and the pre-conditioner circuit. The control circuit is preferably implemented as a single integrated circuit component or "chip" arranged for use with external components in a manner such as to be usable with different types of fluorescent lamp or other loads of similar nature and to permit selection of external component values to obtain optimum performance with any particular type of fluorescent lamp or other load connected thereto. Controllers which are constructed in accordance with the invention are particularly advantageous for energization of fluorescent lamps, halogen lamps or other gaseous discharge devices as well as for energization of other types of loads and it will be understood that fluorescent lamp loads are referred to herein for ease of description and that reference herein and in the claims to fluorescent lamps and fluorescent lamp loads are to be construed as including all other types of loads capable of being energized by the controllers. It will also be understood that the various features of the invention are not limited to implementation of the control circuit through the use of a single integrated circuit.

An important aspect of the invention relates to the discovery and recognition of the sources of reliability problems which resulted when attempting to use cascaded pre-conditioner and DC-AC converter circuits. It was found that with both operating at high frequencies and in close proximity, the signals may be transmitted from each circuit to the other to interfere with proper operation and, in some cases, to cause malfunctions such as to produce complete breakdowns. In accordance with the invention, the operations of the two circuits are synchronized and are either in the same phase or have a fixed or controlled phase relation to one another, preferably with both operated at the same frequency. In an illustrated embodiment, an oscillator circuit which supplies a square wave signal to the DC-AC converter operates during each cycle of the square wave signal to produce a control signal to a pulse width modulator circuit to control the initiation of a pulse of variable width, the pulse width modulator being used to supply the gating pulses which are required for operation of the pre-conditioner circuit.

Further features relate to start up operations after initial energization of the controller and to a number of safety and protection features which insure a high degree of reliability and protect against destructive failures which might otherwise result from use of defective lamps or the absence of lamps or from any one of many possible problems. The control circuit initially obtains power from the input rectifier circuit and subsequently from the DC-AC converter, after applying the required gating signals to the pre-conditioner and converter circuits. The aforementioned pre-heat phase is initiated for heating of the lamp filaments, followed by the aforementioned ignition and operating phases. If ignition is not initially obtained, one or more repeat attempts are made until ignition is successfully obtained. Safeties are automatically effected in response to excessive lamp voltage or currents, and excessive or insufficient voltages or currents at key points in the circuit and, as aforementioned, in response to unsafe voltage-current phase relations in the DC-AC converter circuit.

This invention contemplates other objects, features and advantages which will become more fully apparent from the following detailed description taken in conjunction with the accompanying drawings.

DESCRIPTION OF A PREFERRED EMBODIMENT

Figure 1:
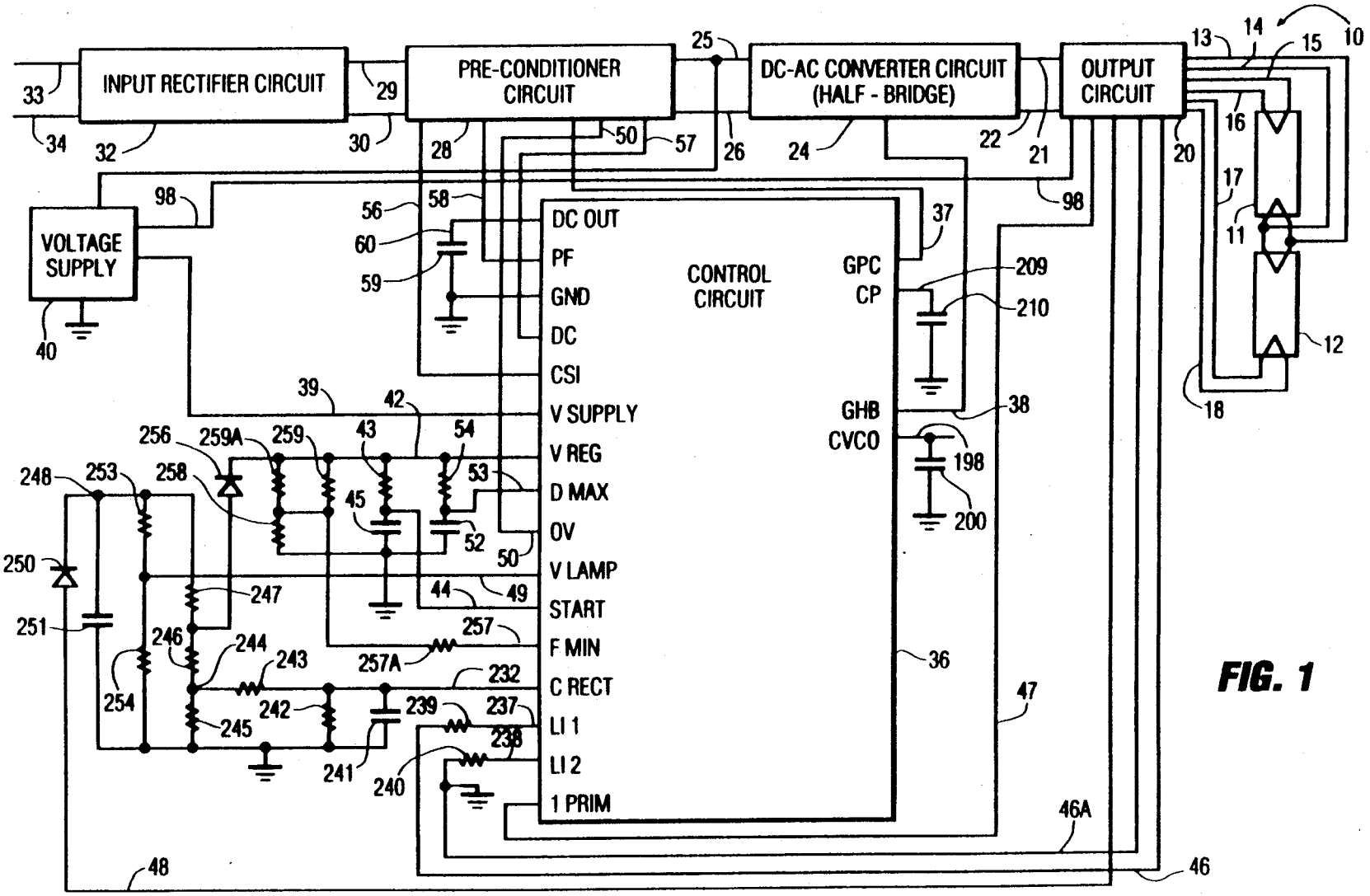
FIG. 1 is a schematic diagram illustrating a fluorescent lamp controller which is constructed in accordance with the invention.

Reference numeral 10 generally designates a fluorescent lamp controller constructed in accordance with the principles of this invention. As shown in FIG. 1, two lamps 11 and 12 are connectable through wires 13–18 to an output circuit 20, wires 13 and 14 being connected to one filament electrode of lamp 11 and one filament electrode of lamp 12, wires 15 and 16 being connected to the other filament electrode of lamp 11 and wires 17 and 18 being connected to the other filament electrode of lamp 12. It will be understood that the invention is not limited to a controller for use with two lamps only.

The output circuit 20 is connected through lines 21 and 22 to the AC output of a DC-AC converter circuit 24 which is connected through lines 25 and 26 to the output of a pre-conditioner circuit 28, the circuit 28 being connected through lines 29 and 30 to the output of input rectifier circuit 32 which is connected through lines 33 and 34 to a source of a 50 or 60 Hz, 120 volt RMS voltage. In the operation of the illustrated embodiment, the pre-conditioner circuit 28 responds to a full-wave rectified 50 or 60 Hz voltage having a peak value of 170 volts, developed at the output of circuit 32 to supply to the DC-AC converter circuit 24 a DC voltage having an average magnitude of about 245 volts. The DC-AC converter circuit 24 converts the DC voltage from the pre-conditioner circuit 28 to a square wave AC voltage which is applied to the output circuit 20 and which has a frequency in a range of from about 25 to 50 KHz. It will be understood that values of voltages, currents, frequencies and other variables, and also the values and types of various components, are given by way of illustrative example to facilitate understanding of the invention, and are not to be construed as limitations.

Both the pre-conditioner circuit 28 and the DC-AC converter circuit 24 include SMPS (switch mode power supply) circuitry and they are controlled by a control circuit 36 which responds to various signals developed by the output circuit 20 and the pre-conditioner circuit 28. In the illustrated controller 10, the pre-conditioner circuit 28 is a variable duty cycle up-converter and is supplied with a pulse-width modulated gating signal "GPC" which is applied through line 37 from the control circuit 36. The DC-AC converter circuit 24 is a half-bridge converter circuit in the illustrated controller 10 and is supplied with a square wave gating signal "GHB" which is applied through a line 38 from the control circuit 36. In accordance with an important feature of the invention, such gating signals are synchronized and may be phase shifted to avoid interference problems and to obtain highly reliable operation. In the illustrated preferred embodiment, they are developed at the same frequency.

Figure 8:
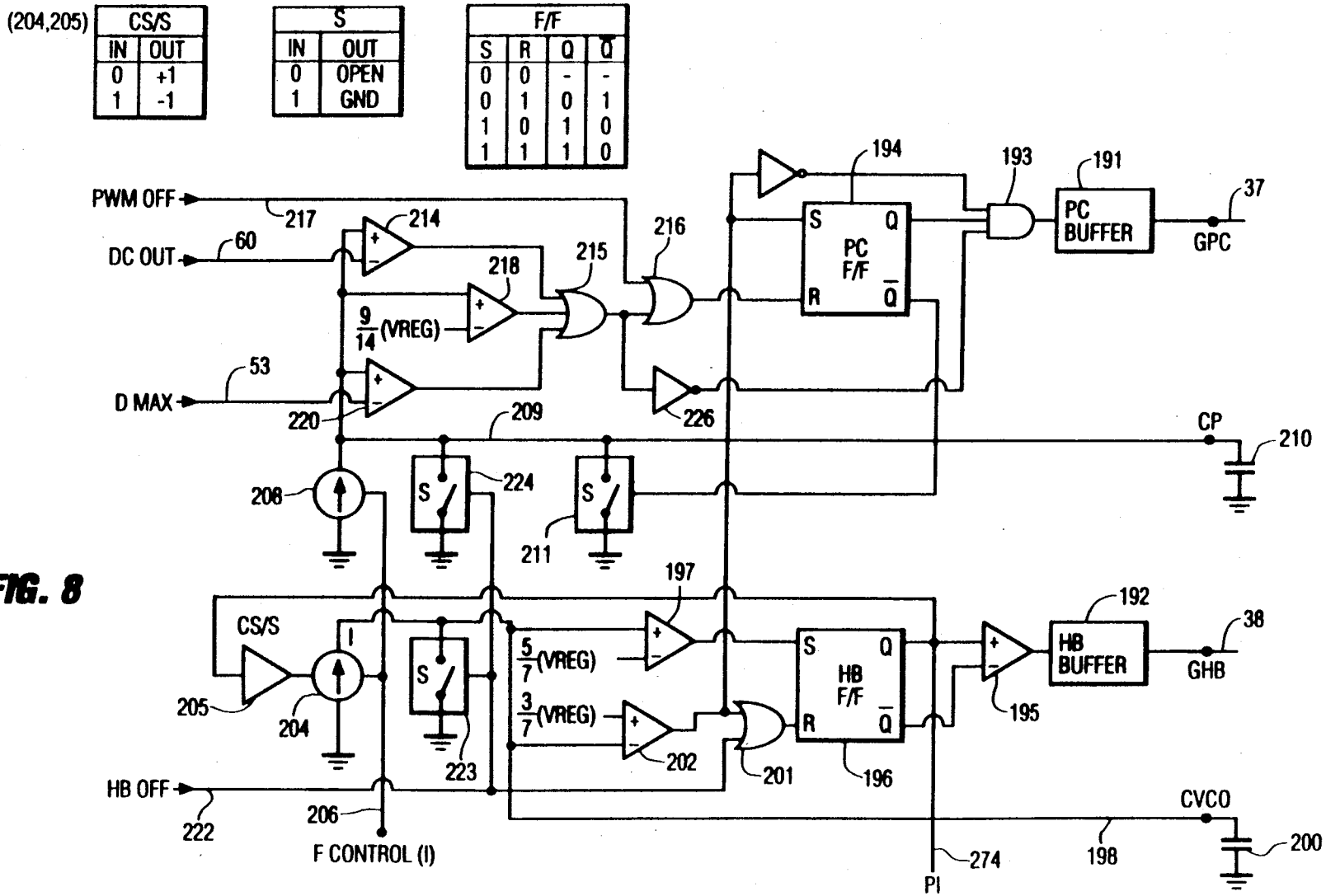
FIG. 8 is a schematic diagram of a portion of logic and analog circuitry incorporated in a control circuit of the controller of FIG. 1 and operative for generating high frequency square wave and pulse-width modulated gating signals.
Figure 9:
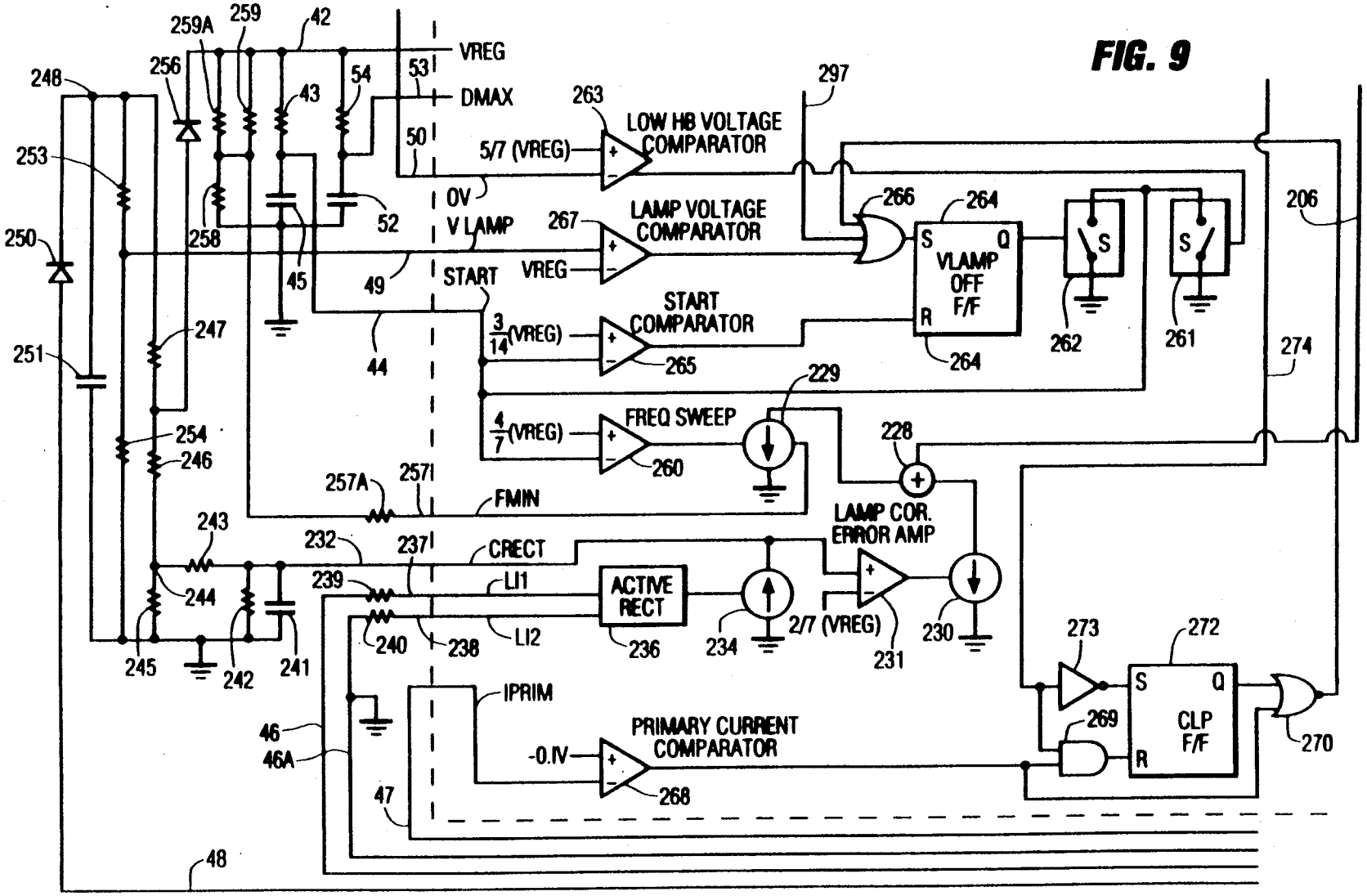
FIG. 9 is a schematic diagram of another portion of logic and analog circuitry incorporated in a control circuit of the controller of FIG. 1 and operative for developing a frequency control signal.
Figures 10, 11:
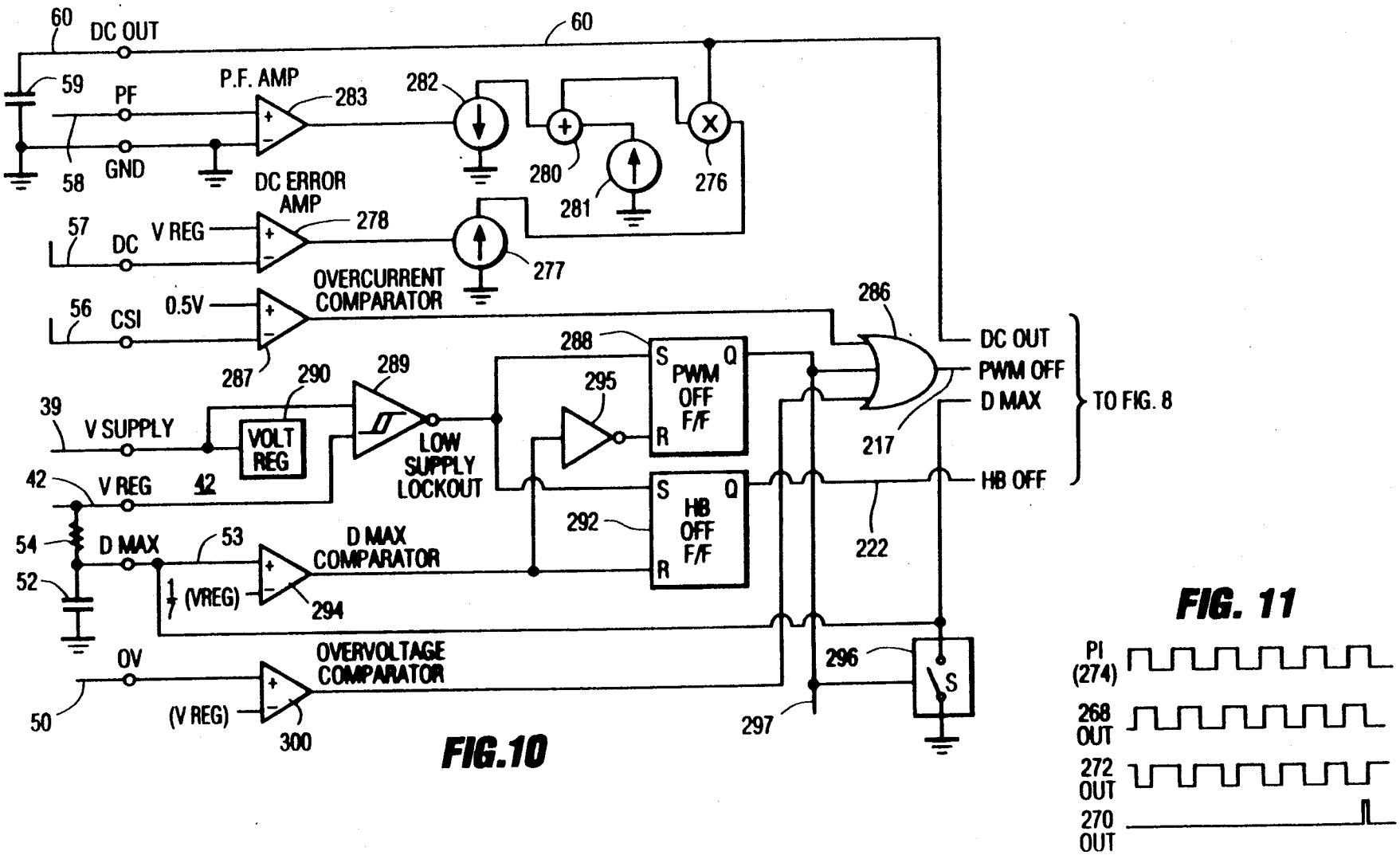
FIG. 10 is a schematic diagram of a third portion of logic and analog circuitry incorporated in a control circuit of the controller of FIG. 1 and operative for developing various control signals.
FIG. 11 is a graph illustrating the waveforms produced in phase comparison circuitry shown in FIG. 9, for explanation of the operation thereof.

The control circuit 36 is an integrated circuit in the illustrated embodiment and it includes logic and analog circuitry which is shown in FIGS. 8, 9 and 10 and which is arranged to respond to various signals applied from the pre-conditioner and output circuits 28 and 20 to develop and control the "GPC" and "GHB" signals on lines 37 and 38. Certain external components and interface circuitry which are shown in FIG. 1 are also shown in FIG. 9 and are described hereinafter in connection with FIG. 9.

Upon initial energization of the controller and during operation thereof, an operating voltage is supplied to the control circuit 36 through a "VSUPPLY" line 39 from a voltage supply 40. A voltage regulator circuit within the control circuit 36 then develops a regulated voltage on a "VREG" line 42 which is connected to various circuits as shown.

As shown, the "VREG" line 42 is connected through a resistor 43 to a "START" line 44 which is connected through a capacitor 45 to circuit ground. Following energization of the controller 10, a voltage is developed on the "START" line 44 which increases as a exponential function of time and which is used for control of starting operations as hereinafter described in detail. In a typical operation, there is a pre-heat phase in which high frequency currents are applied to the filament electrodes of the lamps 11 and 12 without applying lamp voltages of sufficient magnitude to ignite the lamps. The pre-heat phase is followed by an ignition phase in which the lamp voltages are increased gradually toward a high value until the lamps ignite, the lamp voltages being then dropped in response to the increased load which results from conduction of the lamps.

Important features relate to the control of lamp voltages through control of the frequency of operation, using components in the output circuit 20 to obtain resonance and using a range of operating frequencies which is offset from resonance. In the illustrated embodiment, the operating range is above resonance and a voltage is developed which increases as the frequency is decreased. For example, during the pre-heat phase, the frequency may be on the order of 50 KHz and, in the ignition phase, may then be gradually reduced toward a resonant frequency of 36 KHz, ignition being ordinarily obtained before the frequency is reduced to below 40 KHz.

Upon ignition and as a result of current flow through the lamps, the resonant frequency is reduced from a higher no-load resonant frequency of 36 KHz to a lower load-condition resonant frequency close to 20 KHz. The operating frequency is in a relatively narrow range around 30 KHz, above the load-condition resonant frequency. It is controlled in response to a lamp current signal which is developed within the output circuit 20 and which is applied to the control circuit 36 through current sense lines 46 and 46A, the line 46A being a ground reference line. When the lamp current is decreased in response to changes in operating conditions, the frequency is reduced toward the lower load-condition resonant frequency to increase the output voltage and oppose the decrease in lamp current. Similarly, the frequency is increased in response to an increase in lamp current to decrease the output voltage and oppose the increase in lamp current.

As hereinafter described, the use of an operating frequency which is above the load-condition resonant frequency has an important advantage in providing a capacitive load protection feature, operative to protect against a capacitive load condition which might cause destructive failure of transistors in the DC-AC converter circuit 24. Additional protection is obtained through the provision of circuitry within the output circuit 20 which develops a signal on a "IPRIM" line 47 which corresponds to the current in a primary winding of a transformer of the circuit 20 and which is applied to the control circuit 36. When the phase of the signal on line 47 is changed beyond a safe condition, circuitry within the circuit 36 operates to increase the frequency of gating signals on the "GHB" line 38 to a safe value, to provide additional protection of transistors of the DC-AC converter circuit 24.

During the pre-heat and ignition phases of operation, and also in response to lamp removal, a lamp voltage regulator circuit limits the maximum open circuit voltage across the lamps, operating in response to a signal applied through a voltage sense line 48 and to a "VLAMP" input line or terminal 49 of the control circuit 36, through interface circuitry which is shown in FIG. 1 and also in FIG. 9 and which is described hereinafter in connection with FIG. 9. The lamp voltage regulator circuit operates to effect a re-ignition operation in which the operating frequency is rapidly switched to its maximum value and then gradually reduced from its maximum value to increase the operating voltage, to thereby make another attempt at ignition of the lamps.

The lamp ignition and re-ignition operation is also effected in response to a drop in the output voltage of the pre-conditioner circuit 28 below a certain value, through a comparator within circuit 36 which is connected through an "OV" line 50 to a voltage-divider circuit within the pre-conditioner circuit 28, the voltage on the "OV" line 50 being proportional to the output voltage of the pre-conditioner circuit 28 to prevent operation at a low pre-conditioner voltage.

The designation of line 50 as an "OV" line has reference to its connection to another comparator within circuit 36 which responds to an over voltage on the line 50 to shut down operation of the pre-conditioner circuit 28.

Another important protective feature of the controller relates to the provision of low supply lock-out protection circuitry, operative to compare the voltage on the "VSUPPLY" line 39 with the "VREG" voltage on line 42 and to prevent operation of the pre-conditioner circuit 28 and the DC-AC converter circuit 24 until after the voltage on line 39 rises above an upper trip-point. After circuits 28 and 24 are operative, the same circuitry operates to disable the circuits 28 and 24 when the voltage on line 39 drops below a lower trip-point. Then the DC-AC converter circuit 24 is not allowed to be enabled until after the voltage on line 39 exceeds the upper trip point and a minimum time delay has been exceeded. The required time delay is determined by the values of a capacitor 52 which is connected between a "DMAX" line 53 and ground and a resistor 54 connected between line 53 and the "VREG" line 42.

Another feature of the controller 10 relates to the provision of an overcurrent comparator within circuit 36 which is connected through a "CSI" line 56 to the pre-conditioner circuit 28 and which operates to disable application of gating signals from the "GPC" line 37 to the pre-conditioner circuit 28 when the current to the circuit 28 exceeds a certain value.

Additional features relate to the control of the duration of the gating signals applied from the "GPC" line 37 to the pre-conditioner circuit 28 to maintain the output voltage of the pre-conditioner circuit 28 at a substantially constant average value while also controlling the durations of the gating signals in a manner such as to minimize harmonic components in the input current and to obtain what may be characterized as power factor control. In implementing such operations, the control circuit 36 is supplied with a DC voltage on a "DC" line 57 which is proportional to the average value of the output voltage of the pre-conditioner circuit 28.

Circuit 36 is also supplied with a voltage on a "PF" line 58 which is proportional to the instantaneous value of the input voltage to the pre-conditioner circuit 28. An external capacitor 59 is connected to the circuit 36 through a "DCOUT" line 60 and its value has an advantageous effect on the timing of the gating signals. It is also important for loop compensation of the pre-conditioner control circuit 28.

Figure 2:
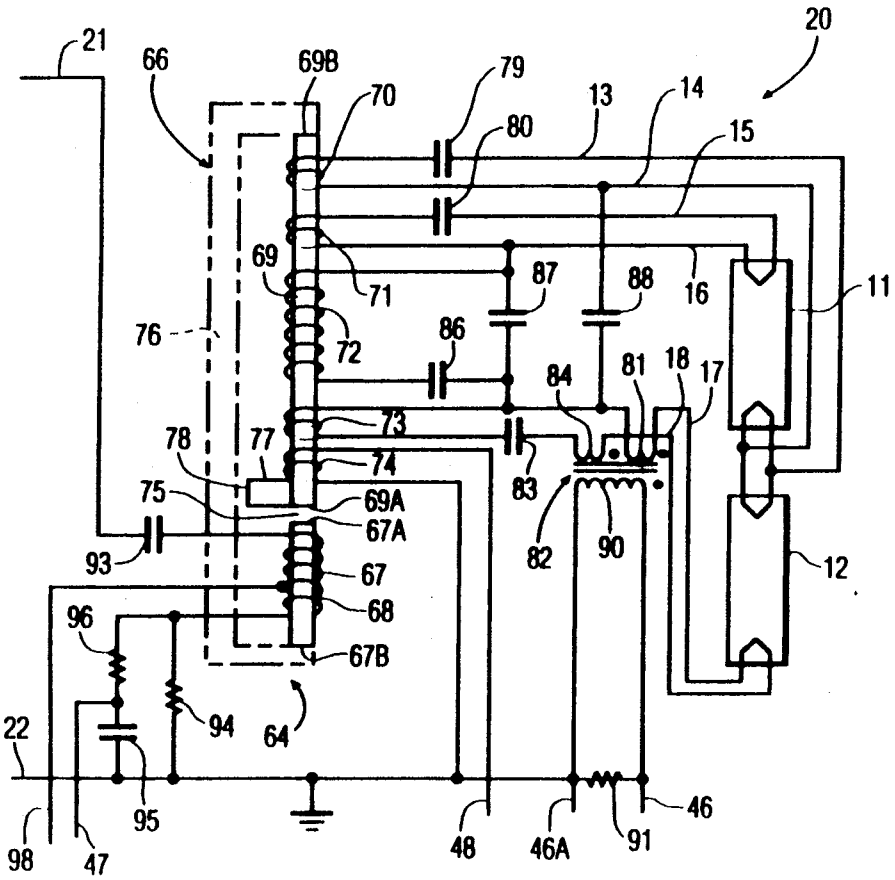
FIG. 2 is a circuit diagram of an output circuit of the controller of FIG. 1.

Output Circuit 20 (FIG. 2)

As shown in FIG. 2, the output circuit 20 comprises a transformer 64 which is preferably constructed in accordance with the teachings in the Stupp et al. U.S. Pat. No. 4,453,109, the disclosure thereof being incorporated by reference. As diagrammatically illustrated, the transformer 64 comprises a core structure 66 of magnetic material which includes a section 67 on which a primary winding 68 is wound and a section 69 on which secondary windings 70–74 are wound, sections 67 and 69 having ends 67A and 69A adjacent to each other but separated by an air gap 75 and having opposite ends 67B and 69B interconnected by a low-reluctance section 76 of the core structure 66. In addition, although not used in a preferred embodiment, the core structure may optionally include a section 77 as illustrated, extending from the end 69A of the section 69 to a point which is separated by a air gap 78 from an intermediate point of the section 77. After ignition, a relatively high current flowing in the secondary windings 70–74 produces a condition in which the resonant frequency is reduced and the "Q" is also reduced.

Secondary windings 70, 71 and 73 are filament windings coupled to the heater electrodes through capacitors which protect against shorting of filament wires. Winding 72 is the lamp voltage supply winding and winding 74 supplies the lamp voltage signal on line 48. As shown, one end of winding 70 is connected through a capacitor 79 to the wire 13, the other end being directly connected to wire 14. One end of winding 71 is connected through a capacitor 80 to the wire 15 while the other end is directly connected to the wire 16. One end of winding 73 is connected to the wire 17 through a primary winding 81 of a current transformer 82 while the other end of winding 73 is connected to the wire 18 through a capacitor 83 and through a second primary winding 84 of current transformer 82. One end of winding 72 is connected to wire 16 while the opposite end thereof is connected through a capacitor 86 to a junction point which is connected through a capacitor 87 to the wire 16, through a capacitor 88 to the wire 14 and through the winding 81 to the wire 17. The current transformer 82 has a secondary winding 90 which is connected in parallel with a resistor 91 and to the current sense lines 46 and 46A.

One end of the primary winding 68 is connected through a coupling capacitor 93 to the input line 21 while the other end thereof is connected through a current sense resistor 94 to the other input line 22 which is connected to circuit ground. Coupling capacitor 93 operates to remove the DC component of a square wave voltage which is applied from the DC-AC converter circuit 24. The "IPRIM" line 47 is connected through a capacitor 95 to ground and through a resistor 96 to the ungrounded end of the current sense resistor 94. A tap on the primary winding 68 is connected through a line 98 to the voltage supply 40, to supply a square wave voltage of about ±20 volts for operation of the voltage supply 40 after a start operation as hereinafter described.

The output circuit operates as a resonant circuit, having a frequency determined by the effective leakage inductance and the secondary winding inductance and the value of capacitor 87 which operates as a resonant capacitor. Capacitor 87 is connected across the series combination of the two lamps 11 and 12 and is also connected across the secondary winding 72 through the capacitor 86 which has a capacitance which is relatively high as compared to that of the resonant capacitor 87 and which operates as a anti-rectification capacitor. Capacitor 88 is a bypass capacitor to aid in starting the lamps and has a relatively low value.

Figure 3:
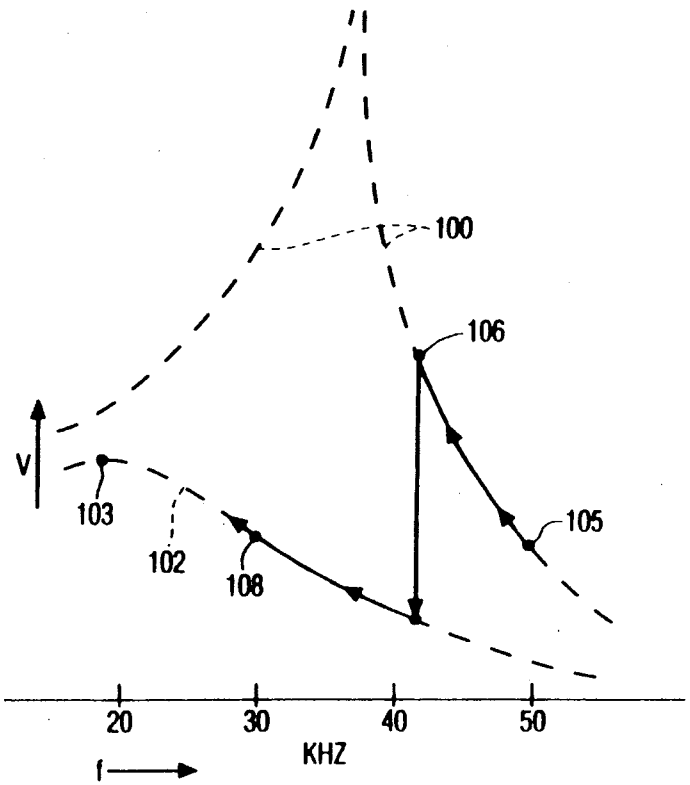
FIG. 3 is a graph illustrating characteristics of the output circuit and its mode of operation.

The graph of FIG. 3 shows the general type of operation obtained with an output circuit 20 such as illustrated. Dashed line 100 indicates a no-load response curve, showing the voltage which might theoretically be produced across the secondary winding 72 with frequency varied over a range of from 10 to 60 KHz, and without lamps in the circuit. As shown, the resonant frequency in the no-load condition is about 36 KHz and if the circuit were operated at that frequency, an extremely high primary current would be produced which might produce thermal breakdowns of transistors and other components. At a frequency of about 40 KHz, a relatively high voltage is produced, usually more than sufficient for lamp ignition. Dashed line 102 indicates the voltage which would be produced across the secondary winding 72 in a loaded condition, with a load which is electrically equivalent to that provided with lamps in the circuit. The resonant frequency at the loaded condition is a substantially lower frequency, close to 20 Khz as illustrated. The resonant peak in the loaded condition is also of broader form and of substantially lower magnitude due to the resistance of the load. It should be understood that resonant peaks are shown for explanatory purposes and that the operating range is offset from resonance.

Actual operation is indicated by a solid line in FIG. 3. Initially, the frequency of operation is at a relatively high value, at about 50 KHz as illustrated and as indicated by point 105. At this point, the voltage across the lamps is insufficient for ignition, but a relatively high voltage is developed across the heater windings 70, 71 and 73. During the pre-heat phase, the frequency is maintained at or near the point 105. Then a pre-ignition phase is initiated in which the frequency is gradually reduced toward the no-load resonant frequency of 36 KHz, following the no-load response curve 100. The lamps 11 and 12 will ordinarily ignite at or before reaching a point 106 at which the frequency is about 40 KHz and the voltage is about 600 volts.

After ignition, the effective load resistance is decreased, shifting the operation to the load condition curve 102. In response to load current after ignition, the frequency of operation is rapidly lowered to a point 108 which is at a frequency of about 30 KHz, substantially greater than the loaded condition resonant peak 103. Operation is then continued within a relatively narrow range in the neighborhood of the point 108, being shifted in response to operating conditions to maintain the lamp current at a substantially constant average value.

Figure 4:
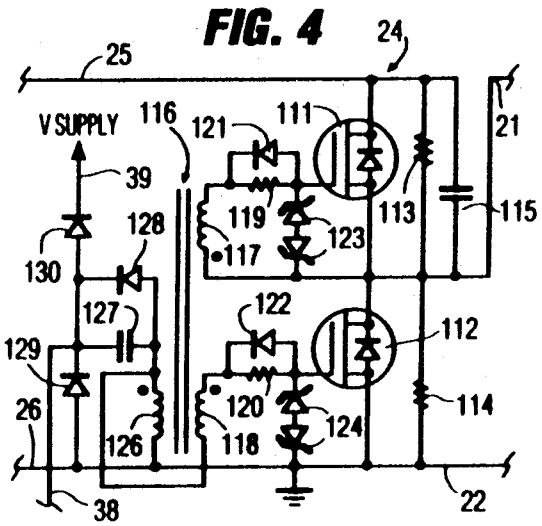
FIG. 4 is a circuit diagram of a DC-AC converter circuit of the controller of FIG. 1.

DC-AC Converter Circuit 24 (FIG. 4)

The illustrated circuit 24 is in the form of a half-bridge circuit and it comprises a pair of MOSFETs 111 and 112, MOSFET 111 being connected between input line 25 and the output line 21, and MOSFET 112 being connected between the output line 21 and the output line 22 which is connected to circuit ground, as is also the case with the input line 26. Resistors 113 and 114 are connected in parallel with the MOSFETs 111 and 112 to split the applied voltage during start up and a snubber capacitor 115 is connected in parallel with the MOSFET 111. A level shift transformer 116 is provided for driving the gates of the MOSFETs 111 and 112 and effecting alternate conduction thereof to produce a square-wave output at the output line 21, shifting between zero and a voltage of about 245 volts The transformer 116 includes a pair of secondary windings 117 and 118 coupled through parallel combinations of resistors 119 and 120 and diodes 121 and 122 to the gates of the MOSFETs 111 and 112, with pairs of protective Zener diodes 123 and 124 being provided, as shown. Resistors 119 and 120 shape the turn-on pulses and diodes 121 and 122 provide fast turn-off. The combination of resistors 119 and 120 and diodes 121 and 122 also operates in conjunction with the gate capacitances of the MOSFETS 111 and 112 to provide turn-on delays and to prevent cross-conduction of the MOSFETS 111 and 112.

The level shift transformer 116 has a primary winding 126 which has one end connected to the grounded input and output lines 26 and 22 and which has an opposite end coupled to the "GHB" line 38 through a level shift and coupling capacitor 127, a diode 128 being connected in parallel with capacitor 127, another diode 129 being connected between line 38 and ground and a third diode 130 being connected between line 38 and the "VSUPPLY" line 39.

Figure 5:
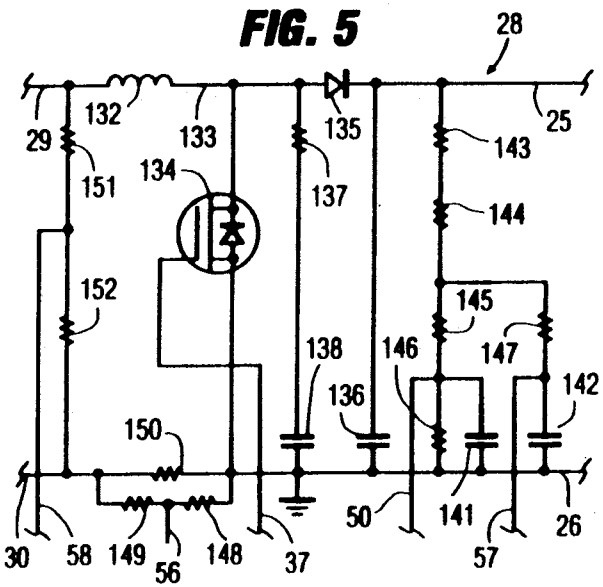
FIG. 5 is a circuit diagram of a pre-conditioner circuit of the controller of FIG. 1.

Pre-conditioner Circuit 28 (FIG. 5)

The circuit 28 comprises a choke 132 which is connected between the input line 29 and a circuit point 133 which is connected through a MOSFET 134 to the grounded output line 26. A diode 135 is connected between circuit point 133 and the output line 25 and a capacitor 136 is connected between the output line 25 and ground. In addition, a resistor 137 and a capacitor 138 are connected in series between the circuit point 133 and ground.

A resistance network is provided for developing the voltages which are applied through the aforementioned "OV" and "DC" lines 50 and 57 to the control circuit 36, such lines being connected through capacitors 141 and 142 to ground. Capacitor 141 has a relatively small capacitance so that voltage on "OV" line changes rapidly in response to changes in the output voltage. Capacitor 142 has a relatively large value so that the response is relatively slow, the voltage on the "DC" line being used for maintaining the average output voltage at a substantially constant level in a manner as hereinafter described. The resistance network includes four resistors 143–146 connected in series from line 25 to line 26 and a resistor 147 connected between line 57 and the junction between resistors 144 and 145, the line 50 being connected to the junction between resistors 145 and 146.

To develop the current signal on the "CSl" line 56, it is connected through resistors 148 and 149 to grounded output line 26 and the input line 30 with a resistor 150 being connected between lines 26 and 30. To develop a voltage proportional to input voltage on the "PF" line 58, it is connected through a resistor 151 to line 29 and through a resistor 152 to the line 30.

In operation of the pre-conditioner circuit 28, high frequency gating pulses are applied through the "GPC" line 37 to the gate of the MOSFET 134. During each pulse, current builds up through the choke 132 to store energy therein. At the end of each pulse, a "fly-back" operation takes place in which the stored energy is transferred through the diode 135 to the capacitor 136. As hereinafter described, the widths of the gating pulses applied through the "GPC" line 37 are controlled from the voltage developed on the "PF" line 58 during each half cycle of the full wave rectified 50 or 60 Hz voltage which is supplied to the pre-conditioner circuit 28 and the widths of the gating pulses are also controlled from the voltage developed on the "DC" line 57. The controls are effected in a manner such that the average value of the input current varies in proportion to the instantaneous value of the input voltage while, at the same time, the output voltage of the pre-conditioner circuit 28 is maintained substantially constant.

The capacitance of the output capacitor 136 is relatively large, such that the product of the capacitance and the effective resistance of the output load is large in relation to the duration of one half cycle of the full wave rectified 50 or 60 Hz voltage supplied to the circuit. The duration of each gating pulse can be varied to vary the average input current flow during the short duration of each complete gating pulse cycle in accordance with the instantaneous value of the input voltage and each pulse results in only a relatively small increase in the output voltage across the large output capacitance. At the same time, the durations of the pulses can also be controlled in a manner such as to control the total energy transferred in response to all of the high frequency gating pulses applied during each complete half cycle of the applied full wave rectified low frequency 50 or 60 Hz voltage and to maintain the voltage across the output capacitor 136 substantially constant and at the desired level.

Figure 6:
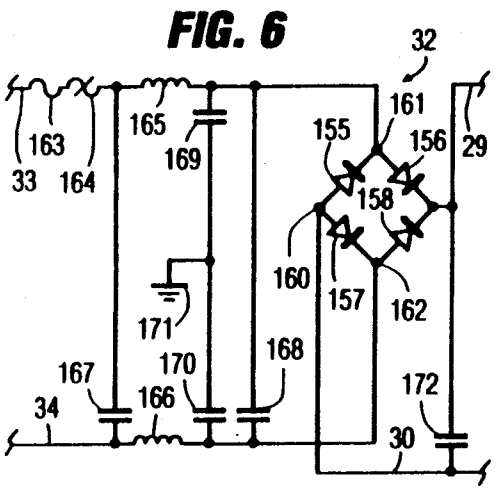
FIG. 6 is a circuit diagram of an input rectifier circuit of the controller of FIG. 1.

Input Rectifier Circuit 32 (FIG. 6)

The circuit 32 includes four diodes 155–158 forming a full wave bridge rectifier to provide output terminals 159 and 160 connected to lines 29 and 30 and input terminals 161 and 162 which are connected through a filter network and through protective fuse devices 163 and 164 to the input lines 33 and 34. The filter network includes series choke coils 165 and 166, input and output capacitors 167 and 168 and a pair of capacitors 169 and 170 to an earth ground 171, separate from the aforementioned circuit or reference ground for the various circuits of the controller 10. A capacitor 172 is connected between the output lines 29 and 30 and supplies current during conduction of the MOSFET 134 of the pre-conditioner circuit 28 (FIG. 5). The value of capacitor 172 is such as to provide a time constant which is relatively short as compared to one cycle of the input voltage to the circuit 32, but which is longer than the duration of each high frequency gating pulse cycle.

The input current flow to the bridge rectifier is thus in the form of short high frequency pulses of varying durations. However, the filter network formed by components 165–170 and 172 operates to average the value of each pulse over each complete gating cycle and minimizes the transmission of high frequency components to the input power lines.

Figure 7:
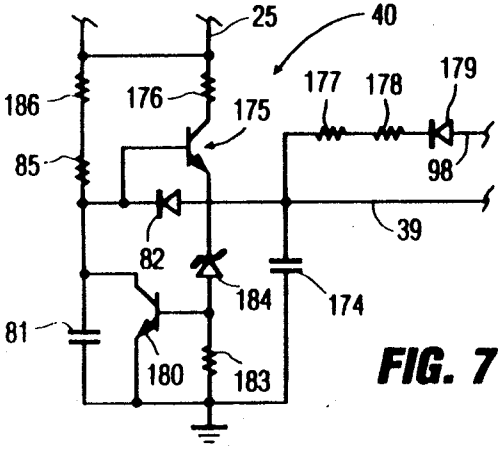
FIG. 7 is a circuit diagram of a voltage supply circuit of the controller of FIG. 1.

Voltage Supply Circuit 40 (FIG. 7)

The voltage supply circuit 40 is arranged to supply a voltage on the "VSUPPLY" line 39 which is obtained directly through the pre-conditioner circuit 28 and input rectifier circuit 32 during a start-up operation and which is obtained from the DC-AC converter circuit 24 when it becomes operative after start-up. Line 39 is connected between an output capacitor 174 and ground and is connected to the emitter of a transistor 175 the collector of which is connected through a resistor 176 to the output line 25 of the pre-conditioner circuit 28. When the controller is initially energized, and before the MOSFET 134 is conductive, there is a path for current flow from the output of the input rectifier circuit and through choke 132, diode 135, resistor 176 and transistor 175 to the line 39, such that the required voltage on line 39 can be developed through conduction of the transistor 175. The line 39 is also connected through resistors 177 and 178 and a diode 179 to the line 98 which is connected to a tap of the primary winding 68 of the transformer 64 of the output circuit 20, so that the required voltage on line 39 can be obtained from the output circuit 20 when power is applied thereto.

The voltage at line 39 is regulated by a transistor 180 which has a grounded emitter, a collector connected through a capacitor 181 to ground and through a diode 182 to the line 39 and a base connected through a resistor 183 to ground and through a Zener diode 184 to the line 39. The base of transistor 175 is connected through resistors 185 and 186 to the line 25. When the controller 10 is initially energized, there is a path for current flow from the input bridge rectifier 155–158 (FIG. 6) to the line 25, as aforementioned, the capacitor 181 can be charged through the resistors 185 and 186, and a positive bias may be applied to the base of transistor 175 to render it conductive and develop a voltage on the "VSUPPLY" line 39 for operation of the control circuit 36 and to thereafter effect a power up of the pre-conditioner circuit 28, the DC-AC converter circuit 24 and the output circuit 20, as hereinafter described. Then, through current flow through the diode 179 and resistors 178 and 177 after power up, a voltage is developed on the line 39 which is sufficient to cause current flow through the diode 182 and to reverse-bias the base of transistor 175 to cut off current conduction therethrough.

Control Circuit 36 (FIGS. 8–10)

Circuitry within the control circuit 36 and associated external components and interface circuitry are shown in FIGS. 8, 9 and 10. FIG. 8 shows pulse width oscillator and oscillator circuitry for producing the "GPC" and "GHB" gating signals on lines 37 and 38; FIG. 9 shows circuitry for applying variable frequency and control signals to oscillator circuitry shown in FIG. 8; and FIG. 10 shows circuitry for applying control signals to the pulse width modulator circuitry shown in FIG. 8.

Pulse Width Modulator and Oscillator Circuitry (FIG. 8)

As shown in FIG. 8, the "GPC" and "GHB" lines 37 and 38 are connected to the outputs of "PC" and "HB" buffers 191 and 192 of the control circuit 36. The input of the "PC" buffer 191 is connected to the output of an AND gate 193 which has three inputs including one which is connected to the output of a "PC" flip-flop 194 operative for controlling the generating of pulse width modulated pulses. The input of the "HB" buffer 192 is connected to the output of a comparator 195 having inputs connected to the two outputs of a "HB" flip-flop 196 which is controlled to operate as an oscillator and generate a square-wave signal.

Circuits used for the "HB" oscillator flip-flop 196 are described first since they also control the time at which the "PC" flip-flop 194 is set in each cycle, reset of the "PC" flip-flop 194 being performed by other circuits to control the pulse width. As shown, the set input of the "HB" flip-flop 196 is connected to the output of a comparator 197 which has a plus input connected through a "CVCO" line 198 to an external capacitor 200. The minus input of comparator 197 is connected to a resistance voltage divider, not shown, which supplies a voltage equal to a certain fraction of the regulated voltage "VREG" on the line 42, a fraction of 5/7 being indicated in the drawing. The reset input of the "HB" flip-flop 196 is connected to the output of an OR gate 201 which has one input connected to the output of a second comparator 202. The minus input of comparator 202 is connected to the "CVCO" line 198, while the plus input thereof is connected to a voltage divider which supplies a voltage equal to a certain fraction of the "VREG" voltage, less than that applied to the minus input of comparator 197, a fraction of 3/7 being indicated in the drawing.

The "CVCO" line 198 is connected through a current source 204 to ground. Current source 204 is bi-directional and controlled through a stage 205 from the output of the "HB" flip-flop 196 to charge the capacitor 200 at a certain rate when the "HB" flip-flop 196 is reset and discharge the capacitor 200 at the same rate when the "HB" flip-flop 196 is set. The rate of charge and discharge is the same and is maintained at a constant rate which is adjustable under control by a control signal on an "FCONTROL" line 206.

In the operation of the "HB" oscillator circuit as thus far described, the capacitor 200 is charged through the source 204 until the voltage reaches the upper level set by the reference voltage applied to comparator 197 at which time the flip-flop 196 is set to switch the source 204 to a discharge mode. The capacitor 200 is then discharged until the voltage reaches the lower level set by the reference voltage applied to comparator 202 at which time the flip-flop 196 is again reset to initiate another cycle. The frequency is controlled by the charge and discharge rate which is controlled by the control signal on the "FCONTROL" line 206.

In the pulse width modulator circuitry, a current source 208 is provided which is connected between ground and a "CP" line 209 to an external capacitor 210 and which is also controlled by the signal on the "FCONTROL" line 206, current source 208 being operative only in a charge mode. A solid state switch 211 is connected across capacitor 210 and is closed when the flip-flop 194 is reset. When a signal is developed at the output of comparator 202 to reset the "HB" flip-flop 196, it is also applied to the set input of the "PC" flip-flop 194 which then operates to open the switch 211 and to allow charging of the capacitor 210 at the constant rate set by the control signal on the "FCONTROL" line 206.

In normal operation, charging of the capacitor 210 continues until its voltage reaches the level of signal on a "DCOUT" line 60 which is developed by other circuitry within the circuit 36 as hereinafter described in connection with FIG. 10.

The "DCOUT" signal on line 60 is applied to the minus input of a comparator 214, the plus input of which is connected to the "CP" line 209. The output of the comparator 214 is applied through an OR gate 215 and another OR gate 216 to the reset input of the "PC" flip-flop 194 which operates to close the switch 211 and to discharge the capacitor 210 and place the line 209 at ground potential. The line 209 remains at ground potential until the flip-flop 194 is again set in response to a signal from the output of the comparator 202.

The "PC" flip flop 194 may also be reset in response to any one of three other events or conditions. The second input of the OR gate 216 is connected to a "PWMOFF" line 217 which is connected to other circuitry within the control circuit 36, as described hereinafter in connection with FIG. 10. The second input of the OR gate 215 is connected to the output of a comparator 218 which has a plus input connected to the "CP" line 209 and which has a minus input connected to a resistance voltage divider, not shown, which supplies a voltage equal to a certain fraction of the regulated voltage "VREG" on the line 42, a fraction of 9/14 being indicated in the drawing. If, at any time after the flip flop 194 is set, the voltage on line 209 exceeds the reference voltage applied to the minus input of comparator 218, the flip flop 194 will be reset. Thus, there is an upper limit on the width of the generated pulse.

A third input of the OR gate 215 is connected to the output of a comparator 220 which has a plus input connected to the line 209 and a minus input connected to the aforementioned "DMAX" line 53. The "DMAX" line 53 is also connected to other circuitry within the control circuit 36 and the operation in connection with the "DMAX" line 53 is described hereinafter.

Provisions are made for disabling both the half bridge oscillator and pulse width modulator circuits in response to a signal on a "HBOFF" line 222 which is connected to solid state switches 223 and 224 operative to connect the "CVCO" and "CP" lines 198 and 209 to ground. Line 222 is also connected to a second input of the OR gate 201 to reset the "HB" flip flop 196. An inverter circuit 225 is connected between the set input of flip flop 194 and an input of the AND gate 193. Another inverter 226 is connected between the output of the OR gate 215 and a third input of the AND gate 193, for the purpose of insuring development of an output from the pulse width modulator circuit only under the appropriate conditions.

Frequency Control Circuitry (FIG. 9)

The frequency control circuitry shown in FIG. 9 is also incorporated within the control circuit 36 and operates to control the level of the frequency control signal on line 206. Line 206 is connected to the output of a summing circuit 228 which has inputs connected to two current sources 229 and 230. The current source 229 is controlled in conjunction with starting operations and operations in which attempts are made and "retried" operations made when the lamps fail to ignite in a starting operation. The current source 230 is controlled in response to output lamp current.

In normal operation, after ignition, the current of the current source 229 is constant, changes in frequency being controlled solely by the current source 230. Current source 230 is connected to the output of a lamp current error amplifier 231 which has a minus input supplied with a reference voltage developed by voltage divider (not shown) within the circuit 36, a reference voltage of 2/7 of the regulated voltage "VREG" being indicated. The plus input of the comparator 231 is connected to a "CRECT" line 232 and is also connected through a current source 234 to ground. Current source 234 is controlled by an active rectifier 236 having inputs which are connected through "LI" and "LI2" lines 237 and 238 and external resistors 239 and 240 to the current sense lines 46 and 46A. As shown, the current sense line 46A is a ground interconnect line.

The "CRECT" line 232 is connected through an external capacitor 241 and parallel resistor 242 to ground an is also connected through a resistor 243 to a circuit point 244 which is connected through a resistor 245 to ground and through resistors 246 and 247 to a circuit point 248. Circuit point 248 is connected through a diode 250 to the voltage sense line 48, through a capacitor 251 to ground and also through a pair of resistors 253 and 254 to ground, the "VLAMP" line 49 being connected to the junction between resistors 253 and 254. A diode 256 is connected between the junction between resistors 246 and 247 and the "VREG" line 42 to limit the voltage at that junction to the regulated voltage on line 42.

In operation, the active rectifier 236 controls the current source 234 in accordance with the lamp current which is sensed by the current transformer 82. The current source 234, in turn, controls the amplifier 231 to control the current source 230 which operates through the summing circuit 228 and line 206 to control the current source 204 (FIG. 8) and thereby control the frequency of operation.

The "CRECT" line 232 applies a correction signal to adjust the operation in accordance with the type of lamps used, the correction signal being controlled by the lamp voltage and normally being of relatively small magnitude, being essentially zero in some cases. The diode 256 serves to limit the voltage developed at the "CRECT" line during start-up.

To establish a minimum frequency of operation, a control current is applied to the current source 229 through a "FMIN" line 257 which is connected through a resistor 257A to a circuit point which is connected through a resistor 258 to ground and through a pair of resistors 259 and 259A to the "VREG" line 42.

The current source 229 is also controlled by a "frequency sweep" amplifier 260 which has a plus input connected to a reference voltage source, a reference of 4/7 of the regulated voltage on line 42 being shown. The minus input of amplifier 260 is connected to the "START" line 44 and is also connected through two switches 261 and 262 to ground. Switch 261 is controlled by a comparator 263 to be closed when the output voltage of the pre-conditioner circuit 28 is less than a certain threshold value. As shown, a reference voltage of 5/7 of the regulated voltage on line 42 is applied to its plus input and its minus input is connected to the "OV" line 50.

The switch 262 is connected to an output of a "VLAMP OFF" flip-flop 264 which has a reset input connected to the output of a "START" comparator 265. The minus input of comparator 265 is connected to the "START" line 44 and the plus input thereof is connected to a reference voltage source, a reference of 3/14 of the regulated voltage on line 42 being indicated. The set input of the flip-flop 264 is connected to the output of an OR gate 266 which has inputs for receiving any one of three signals which can operate to set the "VLAMP OFF" flip-flop and to cause closure of the switch 262.

One input of OR gate 266 is connected to the output of a lamp voltage comparator 267, the minus input of comparator 267 being connected to the "VREG" line 42 and the plus input thereof being connected to the "VLAMP" line 49. When the lamp voltage exceeds a certain value, a signal is applied from the lamp voltage comparator 267 to set the flip-flop 264 and to thereby effect closure of the switch 262 and grounding of the "START" line 44.

A second input of OR gate 266 is connected to be responsive to setting of a flip-flop of pulse width modulator circuitry shown in FIG. 10 and described hereinafter.

A third input of OR gate 266 is connected to be responsive to a signal which is generated by circuitry described hereinafter, to effect operation of the flip-flop 264 when the phase of the signal on the "IPRIM" is changed beyond a safe value.

In the start operation, the current of the current source 229 has a maximum value and the current of source 230 has a minimum value and the frequency is at a certain maximum value, such as 50 KHz. The voltage applied by the output circuit, once the pre-conditioner and DC-AC converter circuits 28 and 24 are operative, is sufficient for heating the lamp filaments but insufficient for ignition of the lamps. When power is initially supplied to the controller 10, the switch 261 is closed and the switch 262 is open. After the voltage on the "OV" line 50 exceeds 5/7 (VREG), the switch 261 is opened by the low HB voltage comparator 263. Then the voltage of the "START" line 44 will start to rise exponentially in response to current flow through the resistor 43.

When the voltage of the "START" line 44 approaches a certain level, determined by the reference voltage applied to the frequency sweep amplifier 260, at around 4/7 ("VREG"), the ignition phase is initiated. At this time, the frequency sweep amplifier 260 starts to decrease the current through the current source 229 to operate through the summing circuit 228 and the line 206 to decrease the frequency of operation. When the frequency is decreased to a certain value, the lamps will ignite, usually at a frequency above 40 KHz. The lamp operation phase is then initiated. At this time, the effective resonant frequency of the output circuit is lowered substantially. At the same time, the current through the lamps is sensed by the current transformer 82 and a control signal is developed by the active rectifier 236 to operate to drop the frequency to a range appropriate for operation of the lamps, at around 30 KHz.

If the lamps should fail to ignite during the ignition phase, the frequency will continue to be lowered and the lamp voltage will continue to increase until voltage on the "VLAMP" line 49 reaches a certain value, at which time the lamp voltage comparator 267 will apply a signal through the OR gate 266 to set the flip-flop 264 and to effect momentary closure of the switch 262 to ground the "START" line 44 and discharge the capacitor 45. The voltage of "START" line 44 is then dropped below a certain value and a reset signal is applied from the start comparator 265 to reset the flip-flop 264. Then the voltage of the "START" line will again start to rise exponentially. When it reaches a certain higher value, the ignition phase is again initiated through operation of the frequency sweep comparator 260 in the manner as above described. Thus one or more "retry" operations are effected, continuing until ignition is obtained, or until energization of the controller is discontinued.

As aforementioned, the flip-flop 264 may also be operated to a set condition when the phase of the signal on the "IPRIM" line changes beyond a safe value. The circuitry shown in FIG. 9 further includes a primary current comparator 268 having a minus input connected to the "IPRIM" line 47 and having a plus input connected to a source of reference voltage, which is not shown but which may supply a reference voltage of −0.1 volts as indicated. The output of the comparator 268 is connected to one input of an AND gate 269 and is also connected to one input of a NOR gate 270. The output of the AND gate 269 is connected to the reset input of a "CLP" flip-flop 272 having an output connected to a second input of the NOR gate 270. The set input of the flip-flop 272 is connected to the output of an inverter 273. The input of the inverter 273 and a second input of the AND gate 269 are connected together through a line 274 to the half bridge oscillator circuitry shown in FIG. 8, being connected to the output of the half bridge flip-flop 196 The output of the NOR gate 270 is connected through the OR gate 266 to the set input of the flip-flop 264.

In operation, the output of the NOR gate 270 is high only when the flip-flop 272 is reset and, at the same time, the output of the primary current comparator 268 is low. Such conditions can take place only when the phase of the current on the line 47 relative to the signal applied on the line 274 is changed in a leading direction beyond a certain threshold angle which is determined by the reference voltage applied to the primary current comparator 268. The signal on line 274 is supplied from the output of the "HB" flip-flop 196 (FIG. 8) which supplies the gating signals to the DC-AC or half bridge converter circuit 24.

FIG. 11 is a graph which shows the relationships of the voltages on line 274 and at the outputs of comparator 268, flip-flop 272 and NOR gate 270 as the phase of the signal on the "IPRIM" line is advanced in a leading direction. When the trailing edge of the output of comparator 268 occurs before the leading edge of the output of flip-flop 272, the output of NOR gate 270 goes high and is applied through the OR gate 266 to set the "VLAMP" flip-flop 264, and to cause the frequency sweep high in the manner as described above.

The circuitry shown in FIG. 9, including components 268, 269, 270, 272 and 273, is operative in the arrangement as shown for checking only the conduction of one of the MOSFETS of the circuit 24. Normally, it will provide more than adequate protection with respect to the other MOSFET, using the circuitry as shown and described. However, it will be understood that for additional protection or with other types of converter circuits, a phase comparison arrangement as shown may be provided for each other MOSFET or other type of transistor of the converter.

Pulse Width Modulator Control Circuitry (FIG. 10)

The voltage on the "DCOUT" line 60, which controls the width of the pulses generated by the pulse width modulator circuit of FIG. 8, is developed at the output of a multiplier circuit 276 which has one input connected to ground through a current source 277 which is controlled by a DC error amplifier 278. The plus input of the amplifier 278 is connected to the voltage regulator line 42 while the minus input thereof is connected to the "DC" line 57 on which a voltage is applied proportional to the output voltage of the pre-conditioner circuit 28. The other input of the multiplier circuit 276 is connected to the output of a summing circuit 280 which is connected to two current sources 281 and 282.

Current source 281 supplies a constant reference or bias current in one direction while current source 282 supplies a current in the opposite direction under control of the voltage on the "PF" line 58. The source 282 is connected to the output of a "PF" amplifier 283 which has a plus input connected to line 58 and a minus input connected to ground. In operation, the input waveform is, in effect, inverted through control of the current source 282 and then added to a reference determined by the current source 281, the waveform being multiplied by a value proportional to the average output of the pre-conditioner circuit 28.

With proper adjustment, a control of the width of each gating pulse is obtained such that the average input current flow during the short duration of each complete gating pulse cycle is proportional to the instantaneous value of the input voltage to the pre-conditioner circuit. At the same time, the pulse widths are controlled through the current source 277 to control the total energy transferred in response to all of the high frequency gating pulses applied during each complete half cycle of the applied full wave rectified low frequency 50 or 60 Hz voltage. The result is that the output voltage of the pre-conditioner circuit 28 is substantially constant while at the same time, the input current waveform is proportional to and in phase with the input voltage waveform, so that the input current waveform is sinusoidal when the input voltage waveform is sinusoidal.

The "PWMOFF" line 217 is connected to the output of an OR gate 286 which has one input connected to the output of an over-current comparator 287. The plus input of comparator 287 is connected to a reference voltage source (not shown) which may supply a voltage of −0.5 volts, as indicated. The minus input of the comparator 287 is connected to the "CSl" line 56. In operation, if the input current to the pre-conditioner circuit 28 should exceed a certain level, the over-current comparator 287 applies a signal to the OR gate 286 to the line 217 and through the OR gate 216 to reset the pre-conditioner flip-flop 194 (see FIG. 8).

A second input of the OR gate 286 is connected to an output of a "PWM OFF" flip-flop 288 which has a set input connected to the output of a Schmitt trigger circuit 289 having one input connected to the "VSUPPLY" line 39 and having a second input connected to the voltage regulator line 42. As shown, a voltage regulator 290 is incorporated in the control circuit 36 and is supplied with the voltage on line 39 to develop the regulated voltage on line 42. The output of the Schmitt trigger circuit 289 is also applied to the set input of a flip-flop 292 which is connected to the "HBOFF" line 222. In operation, if the supply voltage should drop below a certain level, both flip-flops 288 and 292 are set to disable the pulse width modulator and half bridge oscillator circuits.

The reset input of the flip-flop 292 is connected to the output of a "DMAX" comparator 294 which has a plus input connected to the "DMAX" line 53, the minus input of the comparator 294 being connected to a source of a reference voltage which may be 1/7 ("VREG") as indicated. The reset input of the flip-flop 288 is connected to the output of an inverter 295 which has an input connected to the output of the comparator 294. The "DMAX" line 53 is also connected through a switch 296 to ground, switch 296 being controlled by the "PWM OFF" flip-flop 288.

It is noted that the output of the flip-flop 288 is also connected through a line 297 to a third input of the OR gate 266 in the frequency control circuitry shown in FIG. 9. An overvoltage comparator 300 has an input connected to the "OV" line 50 and an output connected through the OR gate 256 to the "PWM OFF" line 217.

In the operation of the pulse width modulator control circuitry of FIG. 10, the flip-flops 288 and 292 are, of course, in a reset condition when the controller is initially energized. After a certain time delay, as required for the voltage on the "VSUPPLY" and "VREG" lines 39 and 42 to develop, the Schmitt trigger circuit operates to set both flip-flops 288 and 292 but thereafter, the flip-flop 288 is reset through the inverter 295 from the output of the "DMAX" comparator 294. Then, when the "DMAX" capacitor 52 is charged to a value greater than 1/7 (VREG), the "DMAX" comparator operates to reset the "HBOFF" flip-flop 292. At this time, operation of the "HB" oscillator flip-flop 196 (FIG. 8) may commence. The operation of the "PC" flip-flop 194 (FIG. 8) may also commence. Initially the width of the "GPC" gate pulses are controlled by the increasing signal on the "DMAX" line 53 so that the output of the pre-conditioner circuit 28 gradually increases and thus, a "soft" start is obtained.

The "DMAX" voltage thus controls a time delay in turning on the oscillator circuitry after initial energization and thereafter controls the width of pulses generated by the pulse width modulator flip-flop 194, so as to obtain the gradually increasing voltage and the "soft" start.

The system of the invention thus provides dynamic controls which automatically respond to variations in operating conditions and in the values or characteristics of components in a manner such as to obtain safe and reliable operation while at the same time achieving optimum performance and efficiency. In connection with the frequency sweep feature, for example, there can be a substantial variations in the resonant frequency in the output circuit. The required lamp ignition voltage is approached by gradually lowering the frequency from a high frequency to thereby gradually increase the voltage, the operation being temporarily aborted and a "retry" operation being effected only if the lamp voltage exceeds a safe value. If, by contrast, a fixed frequency were chosen for starting and if the resonant frequency shifted from the design value, the chosen frequency might be either so high as to prevent reliable starting or so low as to produce resonant or near resonant conditions, excessive voltages and breakdowns of transistors or other components.

The dual mode control arrangement, using voltage control for ignition and current control after ignition is also highly advantageous as is also the downward shift in the resonant frequency upon ignition. Any possible problems which might result from lamp removal or failure are avoided through the arrangement which rapidly responds to a change in phase beyond a safe value to shift a safe operating level, by shifting to a high frequency.

As a result of these and other features, the controllers as shown and described herein are adaptable for a variety of uses and are highly versatile. When used to control lamps, the light output can be accurately regulated and controlled and the circuitry may be used in manually or automatically controlled dimming arrangements. The controllers can be used with various types of power supplies.

It will be understood that modifications and variations may be effected without departing from the spirit and scope of the novel concepts of this invention.

We claim:

1. A controller for a lamp load comprising:

a DC to AC converter having an AC output for connection to the load and a preconditioner circuit including a switched mode power supply with an output connected to supply DC voltage to the DC to AC converter and means which synchronize the DC to AC converter and the switched mode power supply to operate at the same frequency.

2. The controller of claim 1 wherein the DC to AC converter and the switched mode power supply are synchronized to operate in phase with one another.

3. The controller of claim 1, wherein said means which synchronize include means for synchronizing the frequency of the switched mode power supply to the frequency of the DC to AC converter.

4. The controller of claim 2, wherein said means which synchronize include means for synchronizing the frequency of the switched mode power supply to the frequency of the DC to AC converter.

* * * * *